United States Patent [19]

Saka et al.

[11] Patent Number: 4,795,609

[45] Date of Patent: Jan. 3, 1989

[54] HIGH-STRENGTH STEEL FOR VALVE SPRINGS, PROCESS FOR PRODUCING THE STEEL, AND VALVE SPRINGS MADE OF THE SAME

[75] Inventors: Tsutomu Saka, Kawagoe; Tomohito Iikubo, Nagoya; Yukio Ito, Yokkaichi, all of Japan

[73] Assignees: Daido Tokushuko Kabushiki Kaisha, Aichi; Honda Giken Kogyo Kabushiki Kaisha, Tokyo, both of Japan

[21] Appl. No.: 5,118

[22] Filed: Jan. 20, 1987

[30] Foreign Application Priority Data

Jan. 21, 1986 [JP] Japan ..... 61-11326

[51] Int. Cl.[4] ..... C22C 38/34; C22C 38/44

[52] U.S. Cl. ..... 420/109; 75/55; 75/58; 148/908; 148/335

[58] Field of Search ..... 148/335, 908; 420/109, 420/85; 251/337, 368; 75/55, 58, 49; 267/47

[56] References Cited

U.S. PATENT DOCUMENTS 4,544,406 10/1985 Yamamoto et al. ..... 420/109

4,650,645 3/1987 Kato et al. ..... 420/109

FOREIGN PATENT DOCUMENTS 57-192248 11/1982 Japan ..... 148/335

59-170241 9/1984 Japan ..... 148/908

*Primary Examiner*—Deborah Yee

*Attorney, Agent, or Firm*—Parkhurst, Oliff & Berridge

[57] ABSTRACT

A high-strength steel for valve springs, consisting of 0.50–0.70 wt. % of carbon, 1.50–2.50 wt. % of silicon, 0.50–1.20 wt. % of manganese, 1.50–2.50 wt. % of nickel, 0.50–1.00 wt. % of chromium, 0.20-0.50 wt. % of molybdenum, 0.15–0.25 wt. % of vanadium, and the balance being iron and inevitably included inclusions. Also disclosed is a process for producing such a high-strength steel, which includes a step of minimizing oxygen in a melt of the steel, so as to reduce the oxygen content of the steel to 15 ppm or less, and a step of adding calcium to the melt and thereby controlling the form of the inclusions. The process may further include a step of minimizing titanium and nitrogen in the melt, so as to reduce the titanium and nitrogen content of the steel to 50 ppm or less, and 60 ppm or less, respectively.

6 Claims, No Drawings

HIGH-STRENGTH STEEL FOR VALVE SPRINGS, PROCESS FOR PRODUCING THE STEEL, AND VALVE SPRINGS MADE OF THE SAME

BACKGROUND OF THE INVENTION

1. Field of the Invention

The present invention relates to high-strength steels having excellent fatigue characteristics, for valve springs, and a process for producing such high-strength steels.

2. Discussion of the Prior Art and Problems Solved by the Invention

Valve springs, generally in the form of a coil spring, used for an internal combustion engine of automotive vehicles are operated usually at temperatures in the neighborhood of 150° C., and are subjected to compressive loads periodically applied at a high frequency. As such, the valve springs are considered one of springs that are used under the severest operating conditions.

A commonly known steel material for such valve springs is an oil-tempered wire such as SWO-V, SWOCV-V and SWOSC-V classified according to the Japanese Industrial Standards (JIS). Of these wires, the SWOSC-V wire (oil-tempered wire of silicon chromium steel for valve springs) is widely used as the material for valve springs suitable for internal combustion engines, since this wire exhibits higher fatigue strength and sag resistance (resistance to permanent set), than other oil-tempered wires used for valve springs for other applications. For further improvement in the fatigue strength, the wire is subjected to a nitriding or carbo-nitriding treatment to increase the surface hardness.

Recent developments of internal combustion engines are directed toward satisfying a need for higher output and speed of the engine. This tendency requires the valve springs to provide higher resistance to stresses and longer life expectancy, that is, improved reliability of the valve springs. To meet this requirement, it is desired to develop a steel material for valve springs, which is excellent in strength and fatigue characteristics. Attention is currently directed to the removal of inclusions in the steels, in an effort to improve their properties. For example, there has been an attempt to control the form of such inclusions, by means of ladle-furnace refining techniques such as ASEA-SKF process. Reports indicate that reduction in the size and quantity of the inclusions, and a change in the composition of the inclusions for increased ductility may be effective to improve the properties of a steel material. However, such an improved steel material having an increased strength still considerably suffers from a problem in terms of reliability, due to a large variation in the fatigue strength ($\sigma$WB) in a relatively high hardness range (e.g., $H_B$ hardness higher than 400), and due to reduced fatigue life.

SUMMARY OF THE INVENTION

It is therefore an object of the present invention to provide a highly reliable high-strength steel for valve springs, which overcomes the drawbacks experienced in the prior art, and which is excellent in mechanical strength and fatigue characteristics, in particular, in sag resistance (resistance to permanent set). Another object of the invention is the provision of a process suitable for producing such an improved high-strength steel.

To achieve the above object, the present inventors have studied and analyzed extensively on the conventional techniques for producing steels for valve springs. The study and analysis revealed that higher hardness of the material as a result of an effort to increase the strength caused a decline and a considerable variation in the fatigue strength, due to the presence of small inclusions contained in the material as produced, which was not a cause for such a problem with the conventional material having a relatively low strength. In the light of this observation, the inventors have found it effective to purify a molten steel or to obtain a super-clear steel melt, by means of: effecting a ULO treatment (Ultra-Low Oxygen treatment) and a UL-TiN treatment (Ultra-Low Ti-N treatment), that is, minimizing the grain size and content of inclusions including oxides, and Ti and N; and controlling the form of the inclusions so that the inclusions may be easily transformed and fractured (so that the inclusions exist in the form containing CaO) during hot-rolling of the steel material in question. Further, for obtaining highly reliable high-strength steels for valve springs, it was also found effective to add Ni, Mo, V and other elements to the molten steel so as to prepare a well equilibrated chemical composition of the melt, so that the obtained steel exhibits improved properties such as strength, toughness and a sag resistance.

According to the present invention, there is provided a high-strength steel for valve springs, which consists of 0.50–0.70 wt. % of carbon (C), 1.50–2.50 wt. % of silicon (Si), 0.50–1.20 wt. % of manganese (Mn), 1.50–2.50 wt. % of nickel (Ni), 0.50–1.00 wt. % of chromium (Cr), 0.20–0.50 wt. % of molybdenum (Mo), 0.15–0.25 wt. % of vanadium (V), and the balance being iron (Fe) and inevitably included inclusions. There is also provided according to the invention a process of producing a high-strength steel for valve springs consisting of 0.50–0.70 wt. % of carbon, 1.50–2.50 wt. % of silicon, 0.50–1.20 wt. % of manganese, 1.50–2.50 wt. % of nickel, 0.50–1.00 wt. % of chromium, 0.20–0.50 wt. % of molybdenum, 0.15–0.25 wt. % of vanadium, and the balance being iron and inevitably included inclusions, comprising the steps of minimizing oxygen in a melt of the steel, and optionally minimizing titanium and nitrogen in the melt, and subsequently adding calcium (Ca) to the melt and thereby controlling the form of the inclusions. The minimizing and adding steps indicated above are effected to purify the steel melt, and thereby improve the fatigue characteristics of the steel produced from the melt.

DETAILED DESCRIPTION OF THE INVENTION

Preferred embodiments of the present invention will be described in detail.

There will be first described a chemical composition of the steels of the present invention, and upper and lower limits of the content of the individual components, together with reasons for determining these limits defining permissible ranges of the contents.

C

Carbon (C) is an element effective to increase the strength of the steel. Less than 0.50% of carbon will not give the steel a sufficient strength. However, cementite in the form of a net will easily appear, reducing the fatigue strength of a valve spring made of the steel, if the carbon content exceeds 0.70%. Thus, the permissible range of the carbon content is between 0.50% and 0.70%.

Si

Silicon (Si) is an element effectively added in the form of a solid solution in a ferrite, to increase the strength of the steel, and improve the sag resistance (resistance to permanent set, or settling) of the valve spring. The improvement of the sag resistance of the valve spring is not satisfactory if the silicon content is less than 1.50%. On the other hand, the addition of silicon in an amount exceeding 2.50% will deteriorate the toughness of the material, and give rise to a possible release of free carbon during heat treatment of the material. Thus, the permissible range of the silicon content is 1.50–2.50%.

Mn

Manganese (Mn) is an element effectively used for deoxidizing the steel and improving its hardenability. To this end, the manganese content should be 0.50% or more. With the manganese content exceeding 1.20%, however, the hardenability obtained is so high as to deteriorate the toughness, and easily cause deformation of the material during a quenching process. Thus, the permissible content of manganese ranges from 0.50% to 1.20%.

Ni

Nickel (Ni) is an element added to the melt, for the purposes of increasing the toughness of the material after quenching and tempering, and forming residual austenite during the quenching, intended to make it possible to perform cold forming of the obtained steel (for example, cold-coiling of the material). Less than 1.50% of nickel addition will not provide a satisfactory improvement in the toughness, and a sufficient amount of austenite. The improvement in the toughness is saturated at 2.50% of nickel addition, and an excess over this upper limit will provide no improvement, and merely increase the cost. Thus, the permissible range of the nickel content is between 1.50% and 2.50%.

Cr

Chromium (Cr) is an element effective to prevent decarbonization and graphitization of a high-carbon steel. However, a sufficient effect is not expected if the chromium content is less than 0.50%, and the toughness is deteriorated if the content exceeds 1.00%. Thus, the permissible range of the chromium content is defined by 0.50% and 1.00%.

Mo

Molybdenum (Mo) is an element effective to improve the sag resistance (resistance to permanent set) of the valve spring steel. The effect obtained by the molybdenum addition is not sufficient if the content is less than 0.20%. The effect is saturated when the content exceeds 0.50%. Further, an excess over this upper limit will cause undissolved compound carbides to be formed in the austenite, which may grow into a lump that has an adverse effect on the fatigue strength of the steel, as non-metallic inclusions will have. Thus, the permissible range of the molybdenum content is between 0.20% and 0.50%.

V

Vanadium (V) is an element that is highly effective to reduce the crystal grain size of the steel during a rolling operation at low temperatures, and is conducive to enhancing the characteristics and reliability of the valve springs, and to precipitation hardening of the material upon quenching and tempering. For these effects of vanadium to be sufficient, the content must be 0.15% or more. However, the addition of more than 0.25% of vanadium will lead to deterioration of the toughness and other characteristics of the valve spring. Thus, the vanadium content must be held within a range between 0.15% and 0.25%.

According to the present invention, the contents of impurities that are inevitably included in the steel melt are preferably kept to an irreducible minimum. In particular, oxygen (O) contributes to the formation of oxide inclusions which may cause a fatigue fracture of the steel. Therefore, the oxygen content is preferably held 15 ppm or less. This minimization of the oxygen content facilitates the control of the composition, form and grain size of the inclusions in the melt, which will be described. Nitrogen (N) contributes to the formation of inclusions containing Ti and N, and is preferably 60 ppm or less. It is further preferred that the content of titanium in the melt be held 50 ppm or lower, by selecting the raw material including a small content of titanium, so that the quantity of Ti-N inclusions may be minimized. Each of the contents of sulfur (S) and phosphorus (P) that deteriorate the fatigue strength of the valve spring, is preferably 0.010% or less.

As described above, the treatments to be effected according to the present invention to purify the molten steel includes a ULO treatment for minimizing the oxygen content, a UL-TiN treatment for minimizing the titanium and nitrogen contents, and a treatment for controlling the form of the inclusions in the melt. It is important that at least the ULO treatment be conducted before the control of the inclusions is effected. In this respect, it is noted that the conventionally practiced treatment to control the form of the inclusions consists in a mere practice of an ASEA-SKF process or other ladle-furnace refining process on a prepared steel melt. This conventional technique, by which the oxygen content is lowered by a small amount from the original 20–25 ppm level to about 19 ppm, is not satisfactory. Further, the composition of the inclusions includes $Al_2O_3$, taking the form of $SiO_2$—$Al_2O_3$ or $SiO_2$—$Al_2O_3$—MgO, either of which is rich in $SiO_2$, whereby the size reduction of the inclusions and the ductility of the produced steel are not satisfactory.

According to the present invention, the treatment to control the form of the inclusions requires adding calcium (Ca) into the steel melt in a ladle furnace, by means of Ca injection or by introducing a Ca wire, or by other suitable methods. In conjunction with the preceding ULO treatment or combined ULO and UL-TiN treatment for minimizing the crystal grain size and quantity of the oxide inclusions, the calcium addition results in changing the starting form of the inclusions to $Al_2O_3$—CaO, $SiO_2$—CaO, CaO—$Al_2O_3$—$2SiO_2$, etc. which include CaO compound and which are easily transformed and fractured during hot-rolling of the material. The grain size of the thus controlled inclusions is no more than 25 microns, preferably 20 microns or less.

There is no particular method of adding calcium during a ladle-furnace refining process. For example, the calcium addition may be accomplished by a GRAF (Gas Refining Arc Furnace) method, wherein a refining ladle furnace is tightly sealed between its ladle flange and its lid, and is equipped with a submerged-arc heating device, and a stirring device including a porous plug at the furnace bottom, through which an inert gas is blown into the melt. During heating, an arc produced by electrodes is submerged in a slag in the ladle furnace. When the slag is heated to a desired temperature, the electrodes are removed through the openings in the lid, and the electrode openings are closed. Subsequently, an inert gas is blown through the porous plug, for bubbling the melt. These steps of the GRAF method are disclosed in Laid-Open Publication No. 55-89438 of Japanese Patent Application. During this series of refining process, calcium in the form of a powder or a wire is injected or introduced. In this connection, it is preferred that the ladle furnace is lined with a material whose major portion consists of CaO, and that the slag has a high basicity.

It is possible to practice the ASEA-SKF process for effecting the calcium addition to control the form of the inclusions.

The ULO treatment to minimize the oxide inclusions may include: (1) promoting deoxidation and degassing of the molten melt; (2) protecting the melt against contamination by oxygen in the atmosphere from the preparation of the melt to the solidification or casting of the melt; (3) protecting the melt against contamination by the refractories used; and (4) promoting floatation of the inclusions in the ingot casing for casting, and removal of the inclusions on the surface. By effecting at least one of the above four operations, the oxygen content of the obtained steel may be lowered to 15 ppm or less.

An example of the ULO treatment is implemented in the following manner:

A desired steel melt is prepared in a basic electric arc furnace in a UHP (Ultra High Power) process, and subsequently, the prepared melt is, after oxidizing smelting, subjected to a preliminary deoxidation process by addition of Fe-Si and Al, to obtain a reducing slag having a higher level of basicity. The melt is then transferred into a ladle, and two legs of an R-H circulation flow degassing equipment are submerged into the melt in the ladle, so that the melt is drawn into a vacuum vessel of the degassing equipment. The vacuum within the vessel is maintained at less than 0.1 torr., by means of a large-capacity discharge pump, and a small flow of Ar gas is introduced into the melt mass so that the melt is bubbled into the vacuum vessel, while the reaction between carbon and oxygen in the melt proceeds rapidly, whereby the melt is deoxidized. When the carbon-oxygen reaction has reached a substantially equilibrium state, a suitable deoxidizer such as Al is added. The degassing operation is further continued and the amount of Al to be added is finely adjusted, in order to facilitate floatation separation or removal of products created during the deoxidization, and to maintain stability of the deoxidizing condition. After the R-H circulation flow degassing operation, the content of oxygen is lowered down to about 15 ppm. To ensure the oxygen content not higher than 15 ppm, it is necessary to protect the melt against contamination during solidification of the melt or ingot-casting, and to promote the removal of the products formed during the deoxidization. To this end, high-quality refractories are used for the vacuum vessel, ladle, melt introducing conduit and runner bricks. Further, a flow of the melt into the ladle is insulated from the atmosphere by argon gas, and an anti-oxidation agent is introduced into a casting mold to avoid formation of an oxidized film within the mold. Thus, the oxidation by the atmosphere is prevented. In addition, the showering of the melt during an initial period of solidification is restrained, for promoting upward movements of the non-metallic inclusions toward the melt surface. With the above operations, the oxygen content of the obtained steel products can be stably lowered to a considerably low level.

The UL-TiN treatment includes: (1) selecting the raw materials so as to obtain a steel melt containing a reduced Ti content as low as about 30–50 ppm; and 2) effecting a degassing operation to reduce the nitrogen content down to about 40–60 ppm. If these UL-TiN treatment operations are accomplished following the ULO treatment, the inclusions involving oxides and Ti and N can be drastically reduced.

EXAMPLES

Various kinds of steel melts having different chemical compositions as listed in Table 1 were prepared, and the melts were subjected to at least one of the ULO treatment, UL-TiN treatment and inclusion control treatment (ICT), as also indicated in the table.

The ULO treatment was conducted in the following manner:

R-H circulation degassing time: 25 minutes

Refractories used: High-alumina bricks, and basic refractory bricks

Slag: Basic slag $CaO/S_1O_2>3$)

The UL-TiN treatment was conducted by using raw materials of metallic Si, metallic Mn, metallic Ni, metallic Cr and metallic Mo, which have only a trace amount of Ti. The R-H circulation flow degassing time was extended to 35 minutes including that for the preceding ULO treatment, and nitrogen was removed while effecting bubbling or stirring of the melt by blowing an Ar gas.

The treatment (ICT) for controlling the form of the inclusions was effected in a ladle furnace, wherein a Ca-Si powder was introduced together with the Ar gas after the refined melt or adjusted melt was obtained.

The melts subjected to the above treatment or treatments were solidified or cast into steel ingots, and each ingot was bloomed by means of blooming mill, and finally rolled into steel wires for valve springs (coil springs). Test pieces for fatigue and sag-resistance tests were prepared from the respective steel wires, and the prepared test pieces were subjected to an oil-cooled quenching operation at 900° C. for 30 minutes, and to a tempering operation at a suitable temperature. The thus treated test pieces were formed into desired shapes, and were subjected to the fatigue and sag-resistance tests, for measuring the fatigue limit and the residual shear strain.

The test pieces were tested after their hardness was adjusted to HRC 54.

A torsion creep test was carried out as the sag-resistance test (permanent set test). A pre-setting was given to the test piece, and a 100 kfg/mm$^2$ stress was applied to the test piece for 96 hours at the room temperature. The shear creep strain (residual shear strain) $\gamma$ was measured.

The measurements obtained in the fatigue and sag-resistance tests were indicated in Table 1.

TABLE 1

| Sample No. | CHEMICAL COMPOSITION C | Si | Mn | Cr | Ni | Mo | V | PURIFICATION TREATMENT | FORM OF INCLUSIONS | AMOUNT OF INCLUSIONS A + B + C | B + C |
|---|---|---|---|---|---|---|---|---|---|---|---|
| 1 | 0.61 | 1.99 | 0.98 | 0.81 | 1.76 | 0.37 | 0.19 | ULO + UL—TiN + ICT | $Al_2O_3$—CaO | 0.03% | 0% |

TABLE 1-continued

| | | | | | | | | | | | |
|---|---|---|---|---|---|---|---|---|---|---|---|
| 2 | 0.62 | 2.00 | 0.97 | 0.85 | 1.74 | 0.38 | 0.20 | " | $SiO_2$—CaO | 0.03% | 0.01% |
| 3 | 0.61 | 1.98 | 0.96 | 0.84 | 1.73 | 0.36 | 0.21 | " | $Al_2O_3$—CaO—$2SiO_2$ | 0.04% | 0% |
| 4 | 0.60 | 1.97 | 0.95 | 0.86 | 1.75 | 0.35 | 0.22 | ULO + UL—TiN | $Al_2O_3$ | 0.03% | 0.01% |
| 5 | 0.61 | 1.98 | 0.99 | 0.82 | 1.76 | 0.37 | 0.20 | ULO + ICT | $Al_2O_3$—CaO | 0.02% | 0% |
| 6 | 0.63 | 1.96 | 0.97 | 0.83 | 1.75 | 0.38 | 0.21 | " | $SiO_2$—CaO | 0.04% | 0% |
| 7 | 0.62 | 1.97 | 0.96 | 0.82 | 1.74 | 0.35 | 0.22 | " | $Al_2O_3$—CaO—$2SiO_2$ | 0.03% | 0.01% |
| 8 | 0.61 | 1.98 | 0.97 | 0.81 | 1.73 | 0.36 | 0.21 | ULO | $Al_2O_3$ | 0.06% | 0.03% |
| 9 | 0.52 | 1.42 | 0.71 | 0.66 | — | — | — | ULO + UL—TiN + ICT | $Al_2O_3$—CaO | 0.03% | 0% |
| 10 | 0.53 | 1.43 | 0.70 | 0.65 | — | — | — | " | $SiO_2$—CaO | 0.04% | 0.01% |
| 11 | 0.51 | 1.44 | 0.69 | 0.63 | — | — | — | " | $Al_2O_3$—CaO—$2SiO_2$ | 0.03% | 0% |
| 12 | 0.54 | 1.41 | 0.68 | 0.64 | — | — | — | ULO + UL—TiN | $Al_2O_3$ | 0.03% | 0.01% |
| 13 | 0.55 | 1.45 | 0.71 | 0.65 | — | — | — | ULO + ICT | $Al_2O_3$—CaO | 0.04% | 0.01% |
| 14 | 0.53 | 1.44 | 0.73 | 0.63 | — | — | — | " | $SiO_2$—CaO | 0.04% | 0% |
| 15 | 0.54 | 1.45 | 0.71 | 0.65 | — | — | — | " | $Al_2O_3$—CaO—$2SiO_2$ | 0.03% | 0.01% |
| 16 | 0.55 | 1.42 | 0.72 | 0.63 | — | — | — | ULO | $Al_2O_3$ | 0.05% | 0.03% |

| Sample No. | FATIGUE LIMIT ($kfg/mm^2$) ($\times 10^7$ times) | RESIDUAL SHEAR STRAIN $\gamma$ ($\times 10^{-4}$) |
|---|---|---|
| 1 | 95 | 1.7 |
| 2 | 93 | 1.8 |
| 3 | 94 | 1.9 |
| 4 | 87 | 2.0 |
| 5 | 92 | 2.1 |
| 6 | 90 | 1.7 |
| 7 | 91 | 1.6 |
| 8 | 80 | 1.9 |
| 9 | 92 | 6.5 |
| 10 | 90 | 7.0 |
| 11 | 91 | 7.5 |
| 12 | 85 | 7.3 |
| 13 | 87 | 7.2 |
| 14 | 86 | 7.0 |
| 15 | 85 | 6.8 |
| 16 | 77 | 6.7 |

Sample Nos. 1–3 and 5–7: According to the present invention
Sample Nos. 4 and 8: Comparative examples
Sample Nos. 9–16: Conventional steels Further, the test pieces were subjected to a microscopic test for measuring the amounts of inclusions, according to the Japanese Industrial Standards, JIS-G-0555, wherein the test pieces were cut in a plane including the centerline. The amounts of Type A, Type B and Type C inclusions were obtained as a surface percentage on the cut surface. The type A inclusions are inclusions such as sulfides and silicates which were subject to plastic deformation during working on the test pieces. The type B inclusions are granular inclusions such as alumina, which are present in clusters discontinuously formed in the direction of working of the test piece. The type C inclusions are inclusions such as granular oxides, which are irregularly distributed without plastic deformation. The total amount of Type A, B and C inclusions, and the sum of Type B and C inclusions, are indicated in Table 1.

As is understood from Table 1, the conventional steels (Samples 9–16) exhibited poor sag resistance, even if the inclusions were changed to a CaO-based form. Further, the conventional steels having a relatively high hardness had a large variation in the fatigue limit. On the other hand, the steels (Samples 1–3 and 5–7) according to the present invention exhibited remarkable improvements in the sag resistance, and fatigue limit. The fatigue limit values of the instant steels having a relatively high hardness are comparatively high, with a comparatively reduced variation. The comparative examples (Samples 4 and 8) having $Al_2O_3$ inclusions are lower in the fatigue limit than the steels of the present invention.

Further, the amount of the inclusions in the instant steels is considerably smaller than that in the conventional steels. As indicated in the table, the total surface percentage of Type A, B and C inclusions is held less than 0.1%, and that of Type B and C inclusions is held less than 0.05%, according to the present invention.

It will be understood from the foregoing description, that the present invention provides a process wherein a steel melt having a well balanced chemical composition suitable for valve springs is subjected to a purifying operation discussed above, so as to provide reliable, high-strength valve-spring steels which have reduced variation in properties, yet with a high level of mechanical strength, in particular, excellent sag resistance. Thus, the steels according to the invention can be suitably used for fabricating valve springs for internal combustion engines and other purposes, which have high resistance to stresses, and prolonged life expectancy.

What is claimed is:

1. A high-strength steel for valve springs, consisting essentially of 0.50–0.70 wt. % of carbon, 1.50–2.50 wt. % of silicon, 0.50–1.20 wt. % of manganese, 1.50–2.50 wt. % of nickel, 0.50–1.00 wt. % of chromium, 0.20–0.50 wt. % of molybdenum, 0.15–0.25 wt. % of vanadium, and the balance being iron and inevitably included inclusions, said inclusions containing at least one of $Al_2O_3$—CaO, $SiO_2$—CaO, and CaO—$Al_2O_3$—2-$SiO_2$ wherein the surface percentage of the inevitably included inclusions is 0 to 0.1%

2. A high-strength steel according to claim 1, wherein said high-strength steel contains not more than 15 ppm of oxygen, not more than 50 ppm of titanium and not more than 60 ppm of nitrogen.

3. A process of producing a high-strength steel for valve spring, comprising the steps of:

preparing a steel melt consisting of 0.50–0.70 wt. % of carbon, 1.50–2.50 wt. % of silicon, 0.50–1.20 wt. % of manganese, 1.50–2.50 wt. % of nickel, 0.50–1.00 wt. % of chromium, 0.20–0.50 wt. % of molybdenum, 0.15–0.25 wt. % of vanadium, and the balance being iron and inevitably included inclusions;

subjecting said melt to an oxygen-minimizing treatment to minimize oxygen present in said melt, so as to reduce the oxygen content of the steel to 15 ppm or less; and subsequently adding calcium to the melt and thereby controlling the form of the inclusions;

whereby the steel is super-purified, and fatigue characteristics of the steel are accordingly improved.

4. A process according to claim 3, further comprising a step of selecting raw materials so as to obtain a steel melt containing a reduced titanium content, and subjecting said melt to a treatment for minimizing nitrogen in said melt, following said oxygen-minimizing treatment, so as to reduce the titanium content of the steel of 50 ppm or less, and the nitrogen content of the steel to 60 ppm or less.

5. A valve spring formed of a high-strength steel consisting essentially of 0.50–0.70 wt. % of carbon, 1.50–2.50 wt. % of silicon, 0.50–1.20 wt. % of manganese, 1.50–2.50 wt. % of nickel, 0.50–1.00 wt. % of chromium, 0.20–0.50 wt. % of molybdenum, 0.15–0.25 wt. % of vanadium, and the balance being iron and inevitably included inclusions, said inclusions containing at least one of $Al_2O_3$—CaO, $SiO_2$—CaO, and CaO—$Al_2O_3$—$2SiO_2$ wherein the surface percentage of the inevitably included inclusions is 0 to 0.1%.

6. A valve spring according to claim 5, wherein said high-strength steel contains not more than 15 ppm of oxygen, not more than 50 ppm of titanium and not more than 60 ppm of nitrogen.

* * * * *